US006844666B2

(12) United States Patent
Chun et al.

(10) Patent No.: US 6,844,666 B2
(45) Date of Patent: Jan. 18, 2005

(54) COLOR FLAT-PANEL DISPLAY WITH ELECTRODES INCLUDING INSULATORS

(75) Inventors: Hyun Tae Chun, Gumi-si (KR); Nam Je Koh, Gumi-si (KR); Sung Woo Ko, Gumi-si (KR); Dae Soo Kim, Daegu-si (KR)

(73) Assignee: LG. Philips Displays Korea Co., Ltd., Gyeongsangbuk-do (KR)

( * ) Notice: Subject to any disclaimer, the term of this patent is extended or adjusted under 35 U.S.C. 154(b) by 167 days.

(21) Appl. No.: 10/284,368

(22) Filed: Oct. 31, 2002

(65) Prior Publication Data

US 2003/0080675 A1 May 1, 2003

(30) Foreign Application Priority Data

Oct. 31, 2001 (KR) ..... 10-2001-0067384
Oct. 18, 2002 (KR) ..... 10-2002-0063987

(51) Int. Cl.[7] ..... H01J 19/38; H01J 29/46
(52) U.S. Cl. ..... 313/422; 313/495; 313/497
(58) Field of Search ..... 313/495, 496, 313/497, 422, 426, 413, 441

(56) References Cited

U.S. PATENT DOCUMENTS 4,370,594 A * 1/1983 Kuzenetzoff ..... 313/458
5,461,396 A * 10/1995 Nakatani et al. ..... 345/75.1
5,831,382 A * 11/1998 Bilan et al. ..... 313/495

FOREIGN PATENT DOCUMENTS

| | | |
|---|---|---|
| JP | 47-48621 | 12/1972 |
| JP | 53-074357 | 1/1978 |
| JP | 53-038260 | 8/1978 |
| JP | 54-120582 | 9/1979 |
| JP | 56-143487 A | 11/1981 |
| JP | 58-046562 | 3/1983 |
| JP | 01-296535 | 11/1989 |
| JP | 02-250247 | 10/1990 |
| JP | 03-205751 | 9/1991 |
| JP | 04-315746 | 11/1992 |
| JP | 07-282748 | 10/1995 |

* cited by examiner

*Primary Examiner*—Nimeshkumar D. Patel
*Assistant Examiner*—Karabi Guharay
(74) *Attorney, Agent, or Firm*—Birch, Stewart, Kolasch & Birch, LLP

(57) ABSTRACT

Disclosed is a color flat-panel display, which includes a rear glass, a rear electrode, a filament cathode for emitting electrons, a control electrode, a signal modulation electrode, a focus electrode, a horizontal deflection electrode, a vertical deflection electrode, a front glass on which a phosphor screen is formed, and spacers for maintaining an interval between the electrodes. Each electrode member of the control electrode, the signal modulation electrode, the focus electrode, the horizontal deflection electrode and the vertical deflection electrode includes an insulator and a conductive layer formed on a surface of the insulator and acting as an electrode.

20 Claims, 7 Drawing Sheets

COLOR FLAT-PANEL DISPLAY WITH ELECTRODES INCLUDING INSULATORS

This nonprovisional application claims priority under 35 U.S.C. §119(a) on Patent Application No(s). 67384/2001 and63987/2002 filed in the Republic of Korea on Oct. 31, 2001 and Oct. 18, 2002 (respectively), which is herein incorporated by reference.

BACKGROUND OF THE INVENTION

1. Field of the Invention

The present invention relates to a color flat-panel display, and more particularly, to an electrode structure of a color flat-panel display.

2. Discussion of the Related Art

Recently, an electroluminescent display (ELD), a plasma display panel (PDP), a liquid crystal display (LCD) and the like have been developed as a color flat-panel display. In comparison with a cathode ray tube (CRT) that uses an electron beam, however, a conventional color flat-panel display has not reached a satisfactory level in view of performances such as a luminance, a contrast and a color reproduction.

To overcome shortcomings of the conventional color flat-panel display (the ELD, the PDP and the LCD) and implement a high-quality image comparable to the CRT, there have been proposed an improved color flat-panel display that is based on a screen scanning of an electron beam.

Meanwhile, Japan Laid-open Publications No. 3-184247 and No. 3-205751 disclose an image display apparatus for displaying a high-quality image comparable to the CRT on a flat-panel display that uses an electron beam, in which an image displayed on a screen is divided into unit cells constituting a matrix and then an electron beam is deflectively scanned to each unit cell, so that a phosphor screen is light-emitted to thereby display an entire color image.

FIG. 1 is a view of a conventional color flat-panel display based on a screen scanning of an electron beam.

FIG. 1 is an exploded perspective view showing main elements of the conventional color flat-panel display. Referring to FIG. 1, the conventional color flat-panel display includes a rear glass 1, a rear electrode 2, a filament cathode 3, a control electrode 4, a signal modulation electrode 5, a focus electrode 6, a horizontal deflection electrode 7, a vertical deflection electrode 8, and a front glass 9, all of which are arranged one after another. In addition, the rear glass 1 and the front glass 9 are sealed to maintain a vacuum state.

In more detail, the rear electrode 2 is formed of a conductive material such as metal and graphite on a flat panel. The rear electrode 2 is arranged in parallel with the filament cathode 3 and a negative voltage is applied to the rear electrode 2 to thereby cause an electron emitted from the filament cathode 3 to be directed toward the screen.

Generally, the filament cathode 3 is formed coating an oxide cathode material on a surface of a tungsten wire. At this time, a plurality of filament cathodes are arranged to generate the electron beam constantly distributed in a horizontal direction.

As an electrode for drawing the electron beam 11, the control electrode 4 is spaced apart from the filament cathode 3 by a predetermined distance and disposed in a direction of the screen. Also, the control electrode 4 is faced with the rear electrode 2 and formed of a conductive plate in which passing holes are disposed at each predetermined distance in a horizontal direction and formed on a horizontal line facing each filament cathode 3 by a predetermined distance.

The signal modulation electrode 5 includes a row of conductive plates, each of which is arranged on a position facing each passing hole of the control electrode 4 and spaced apart from the control electrode 4 by a predetermined distance. At this time, each conductive plate is thin and long in a vertical direction. Each conductive plate of the signal modulation electrode 5 has passing holes formed in the same plane on a position facing each passing hole of the control electrode 4.

The focus electrode 6 is formed of a conductive plate having passing holes formed on each position facing each passing hole of the signal modulation electrode 5. The horizontal deflection electrode 8 includes two conductive plates meshed with each other on a sectional portion and spaced apart by a predetermined distance on the same plane.

Further, the vertical deflection electrode 8 also includes two conductive plates meshed with each other on a sectional portion and spaced apart by a predetermined distance on the same plane.

Generally, all of the above-described electrodes are manufactured using an Invar (Fe—Ni alloy) in order to prevent an image quality from being degraded due to a thermal deformation. Each of the control electrode 4, the signal modulation electrode 5, the focus electrode 6, the horizontal deflection electrode 7 and the vertical deflection electrode 8 is joined with an insulating adhesive.

FIG. 2 is a view explaining a phosphor screen of the conventional color flat-panel display.

Referring to FIG. 2, a phosphor screen 15 is formed on the front glass 9 and R, G and B phosphors 12 are coated on an inner side of the front glass 9. Black matrixes (BM) 14 are formed between the phosphors 12.

In addition, a metal back 13 is formed on the phosphors 12 to thereby reflect and project a light generated by the phosphors 12 on the front glass 9.

On the basis of the above structure, an operation of the conventional color flat-panel display will be described below with reference to FIGS. 1 and 2.

If a voltage is applied to the filament cathode 3, electrons are emitted. At this time, the filament cathode 3 is heated by passing a current therethrough in order to easily obtain the electron emission.

The electrons emitted from the filament electrode 3 are divided into multiple parts by the passing holes of the control electrode 4 and its amount is controlled.

A passing amount of the electron beam 11 passed through the control electrode 4 is controlled corresponding to an image signal at the signal modulation electrode 5.

The electron beam 11 passed through the signal modulation electrode 5 is focused at the passing holes of the focus electrode 6 due to a static lens effect. The electron beam 11 is deflected by passing both the horizontal deflection electrode 7 and the vertical deflection electrode 8 and then it is scanned to the phosphor 12 of corresponding unit cell 10, thereby displaying a desired image.

At this time, a voltage applied to the electrode adjacent to the screen is maximally of 600 V and a voltage of the screen is approximately of 10,000–14,000 V.

In other words, since a high voltage of approximately 10,000 V is applied to the metal back 13, the electron beam 11 is accelerated to a high energy and collided against the metal back 13, thereby light-emitting the phosphor 12.

FIG. 3 is a view showing a structure of the vertical deflection electrode 8 in the conventional color flat-panel display.

As shown in FIG. 3, the vertical deflection electrode 8 is made in a structure that two conductive plates 8*a* and 8*b* are meshed with each other on a sectional portion and spaced apart by a predetermined distance on the same plane.

In other words, if positive and negative voltages are applied to the conductive plates 8*a* and 8*b* respectively, an electric field is generated, and the electric field causes the electric beam to be deflected, thereby achieving a vertical deflection.

In addition, a horizontal deflection is achieved in the horizontal deflection electrode 7 by the same principle as the vertical deflection.

FIG. 4 is a view explaining an assembly process of the electrodes, in which a pre-sintering state and a post-sintering state are shown.

Explaining the assembly process of the electrodes with reference to FIG. 4, crystalline glass rods 22 of a relatively low melting point are inserted into both sides of amorphous glass rods 21 of a relatively high melting point between the electrodes, and then the sintering process is carried out. Consequently, the crystalline glass rods 22 are melted to wrap the amorphous glass rods 21, thereby acting as an adhesive.

At this time, a gap between both electrodes is maintained as much as a diameter of the amorphous glass rod 21.

However, there is a problem that the electrons can be emitted only when the filament cathode is heated up to a temperature of 750° C. or higher in order for a driving operation. Due to this driving mechanism, 70% or more of the electron beam emitted from the filament cathode in the driving operation is collided against the control electrode and therefore the control electrode is heated to a temperature of 80–150° C. or higher. As a result, there may occur a thermal deformation and a path of the electron beam may be harmfully affected.

To prevent the above problems, an Invar, an expensive metal material of a low thermal expansion, may be used. However, the cost of material is expensive and therefore a manufacturing cost may be increased.

Further, although Korean Patent No. 1999-0048625 discloses a technique of employing a ceramic, there is also a problem that a manufacturing process is very complicated due to a high sintering temperature and the cost of material is very expensive.

SUMMARY OF THE INVENTION

Accordingly, the present invention relates to a color flat-panel display and, more particularly, to an electrode structure of a color flat-panel display.

An object of the present invention is to reduce the cost of material by replacing an electrode of expensive Invar material with that of a metal thin film, simplify a manufacturing process and improve a productivity.

In accordance with an aspect of the present invention, there is provided a color flat-panel display, which includes a rear glass, a rear electrode, a filament cathode for emitting electrons, a control electrode, a signal modulation electrode, a focus electrode, a horizontal deflection electrode, a vertical deflection electrode, a front glass on which a phosphor screen is formed, and spacers for maintaining an interval between the electrodes. Each electrode member of the control electrode, the signal modulation electrode, the focus electrode, the horizontal deflection electrode and the vertical deflection electrode comprises an insulator and a conductive layer acting as an electrode and formed on a surface of the insulator.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

The color flat-panel display of the present invention includes a rear glass, a rear electrode, a filament cathode for emitting electrons, a control electrode, a signal modulation electrode, a focus electrode, a horizontal deflection electrode, a vertical deflection electrode, a front glass on which a phosphor screen is formed, and spacers for maintaining an interval between the electrodes. Each electrode member of the control electrode, the signal modulation electrode, the focus electrode, the horizontal deflection electrode and the vertical deflection electrode includes an insulator and a conductive layer formed on a surface of the insulator and acting as an electrode.

Hereinafter, a color flat-panel display in accordance with the present invention will be described in detail with reference to the attached drawings.

Figure 1:
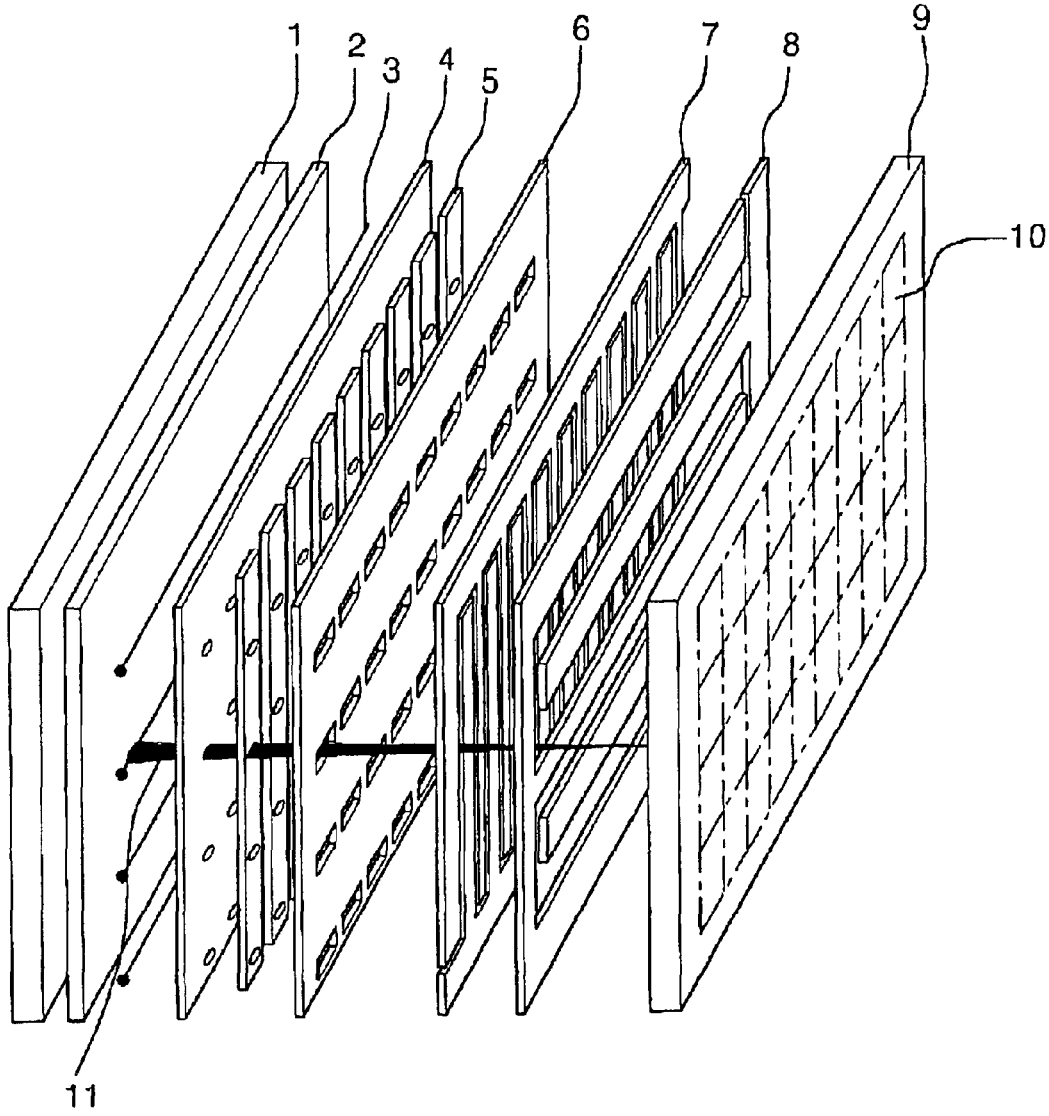
FIG. 1 (Related Art)
FIG. 1 is a perspective view of a conventional color flat-panel display based on a screen scanning of an electron beam.
Figure 2:
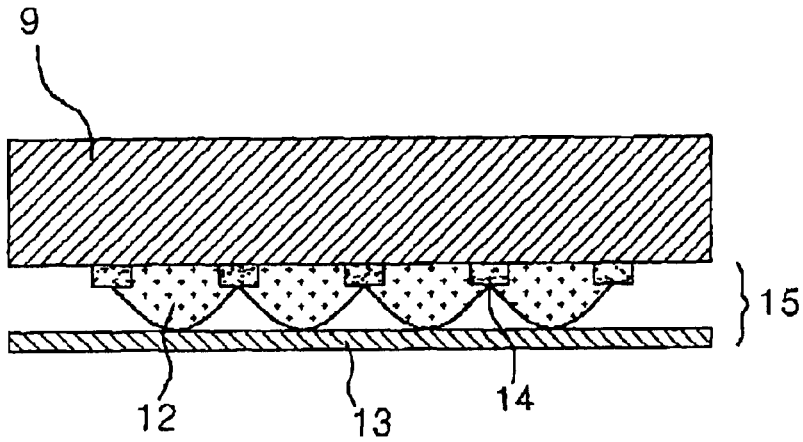
FIG. 2 (Related Art)
FIG. 2 is a cross-sectional view explaining the phosphor screen of the conventional color flat-panel display.
Figure 3:
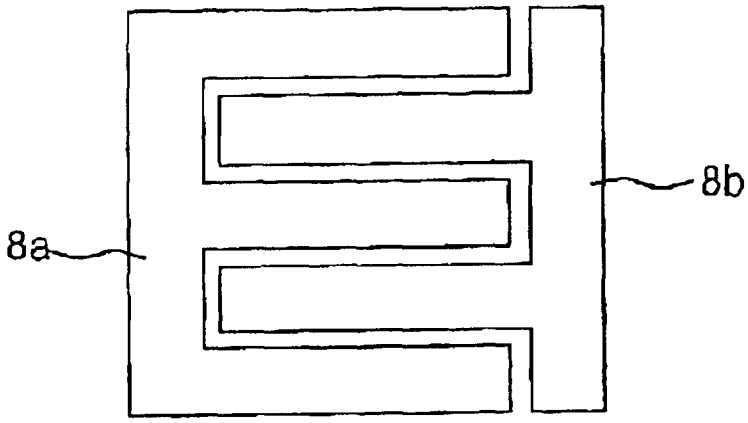
FIG. 3 (Related Art)
FIG. 3 is a cross-sectional view showing a structure of the vertical deflection electrode of the conventional color flat-panel display.
Figure 4:
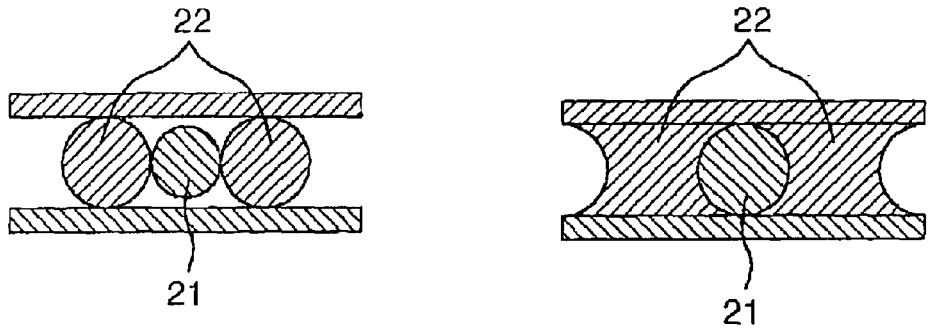
FIG. 4 (Related Art)
FIG. 4 is a cross-sectional view explaining an assembly process of the electrodes, in which a pre-sintering state and a post-sintering state are shown.
Figure 5:
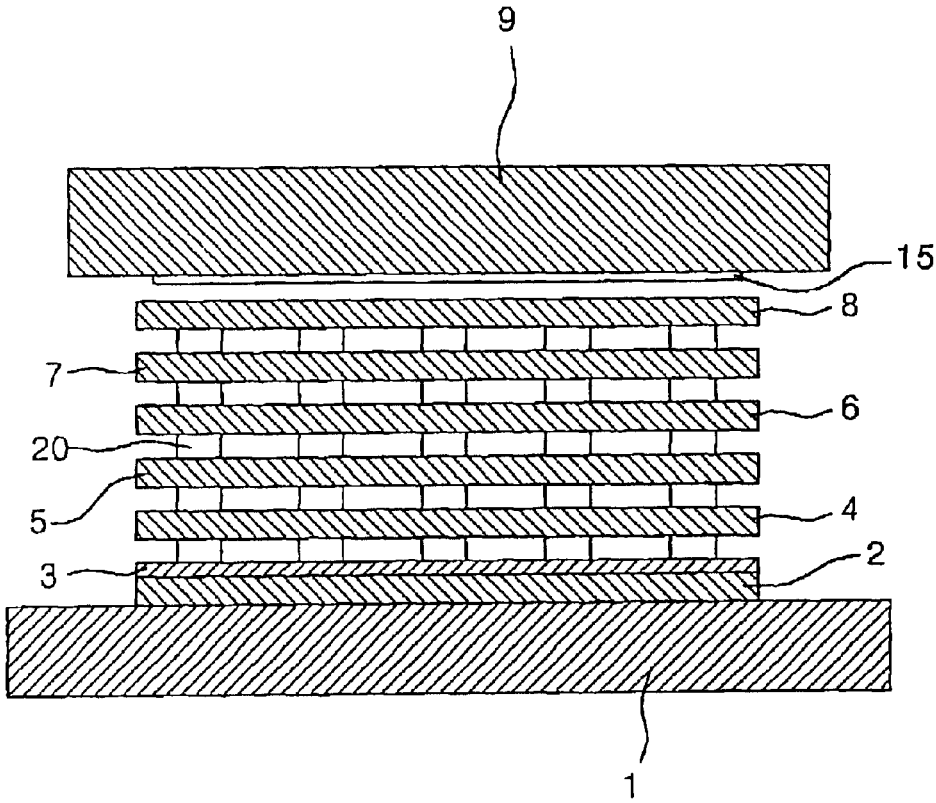
FIG. 5 is a cross-sectional view showing a structure of a color flat-panel display in accordance with an embodiment of the present invention.
Figure 6:
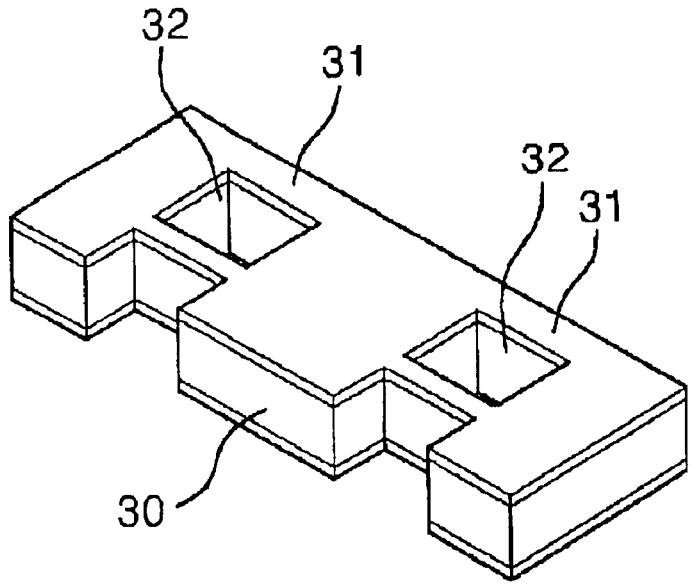
FIG. 6 is a perspective view showing an embodiment of an electrode structure of the color flat-panel display in accordance with the present invention, in which a conductive layer is formed on an insulator.

FIG. 5 is a view showing a structure of a color flat-panel display in accordance with the present invention, and FIG. 6 is a view showing an embodiment of an electrode structure of the color flat-panel display in accordance with the present invention, in which a conductive layer is formed on an insulator.

Referring to FIGS. 5 and 6, the color flat-panel display of the present invention includes a rear glass 1, a rear electrode 2, a filament cathode 3 for emitting electrons, a control electrode 4, a signal modulation electrode 5, a focus electrode 6, a horizontal deflection electrode 7, a vertical deflection electrode 8, a front glass 9 on which a phosphor screen 15 is formed, and spacers 20 for maintaining an interval between the electrodes. Each electrode member of the control electrode 4, the signal modulation electrode 5, the focus electrode 6, the horizontal deflection electrode 7 and the vertical deflection electrode 8 includes an insulator 30 and a conductive layer 31 formed on a surface of the insulator 30 and acting as an electrode.

It is desirable that the insulator 30 be formed of a ceramic-based insulating material.

The ceramic-based insulating material is inexpensive and its insulativity is excellent. Also, it is easy and simple to process the ceramic-based insulating material.

Preferably, main component of the insulator 30 is at least one selected from the group consisting of PbO, $B_2O_3$, $SiO_2$ and $Al_2O_3$.

It is preferable that main component of the conductive layer 31 formed on the surface of the insulator 30 be any one selected from the group consisting of Au, Al, Pt, Ag, Cu and Ni as a metal material having an excellent conductivity.

Particularly, the component Al has an advantageous productivity and its cost is inexpensive.

Further, it is desirable that the insulator 30 should be 50–150 $\mu$m thick.

If the insulator is less than 50 $\mu$m thick, the strength of the insulator becomes weak and therefore the insulator may be fragile or broken by an impact. On the other hand, if the insulator is more than 150 $\mu$m thick, it causes the cost of material to be increased. Also, the manufacturing cost is increased according to an increase of the printing number of times, and an operation of the conductive layer 31 formed on the insulator 30 as the electrode may be degraded.

Further, it is desirable that the conductive layer 31 formed on one side of the insulator 30 be 4–50 $\mu$m thick.

If the conductive layer 31 is less than 4 $\mu$m thick, it is difficult to act as the electrode. In the other hand, if the conductive layer 31 is more than 50 $\mu$m thick, the cost of material and the manufacturing cost may be increased.

Considering an operation of the electrodes, a cost of the electrodes, a weight of the electrodes, etc., it is desirable that each electrode be 58–250 $\mu$m thick.

Considering a weight, a thickness and a manufacturing cost of the color flat-panel display, it is desirable that the assembly in which the respective electrodes are coupled should be 5000 $\mu$m or less thick.

In addition, a shape of an electron beam-passing hole 32 can be changed according to the kind of electrodes.

An operation of the color flat-panel display will be described below. If a voltage is applied to the filament cathode 3, electrons are emitted. At this time, the filament cathode 3 is heated by passing a current therethrough in order to easily obtain the electron emission.

The electrons emitted from the filament electrode 3 are divided into multiple parts by the passing holes of the control electrode 4 and its amount is controlled.

A passing amount of the electron beam 11 passed through the control electrode 4 is controlled corresponding to an image signal at the signal modulation electrode 5.

The electron beam 11 passed through the signal modulation electrode 5 is focused at the passing holes of the focus electrode 6 due to a static lens effect. The electron beam 11 is deflected by passing both the horizontal deflection electrode 7 and the vertical deflection electrode 8 and then it is scanned to the phosphor 12 of corresponding unit cell 10, thereby displaying a desired image.

Hereinafter, a structure of the electrodes of the color flat-panel display in accordance with the present invention will be described in detail.

In a method of manufacturing the electrodes, all of the methods of manufacturing a thin film, such as a deposition process and a sputtering process, are applicable to a method of forming the conductive layer 31 on both a top surface and a bottom surface of the insulator 30. Further, a printing method is also applicable.

Explaining the printing method, in order to obtain an easy separation of the electrode from the glass, a chemical material that is volatile at a high temperature is coated and dried. Then, the conductive layer 31 acting as the electrode is printed, patterned and then dried.

Next, the insulator 30 is again patterned and dried. Thereafter, the conductive layer 31 is patterned, thereby achieving the sintering process.

As another method, after the insulator 30 is first manufactured, the conductive layer 31 is printed on both surfaces of the insulator 30.

In case where the printing method is used, in order to prevent a thermal property of the conductive layer 31 and the insulator 30, i.e., a crack of the conductive layer 31 in the sintering process, it is important to adjust a thermal expansion coefficient of the conductive layer 31 and the insulator 30 and to design a temperature profile such as a temperature's rising and falling.

Each electrode is manufactured using the above-described method and the spacers 20 composed of an insulator are formed in order to constantly maintain the interval between the electrodes.

It is desirable that the spacers 20 be manufactured using the printing method. Meanwhile, in one method, the spacers 20 can be manufactured performing a patterning process by using the printing method while maintaining a constant distance above each electrode. In another method, the spacers 20 are manufactured and then inserted between the electrodes. Thereafter, the sintering process is performed to maintain an interval between the electrodes. At the same time, the spacers 20 act as an adhesive between the electrodes.

Of course, like the prior art, the amorphous glass and the crystalline glass rod can be also used.

Figure 7:
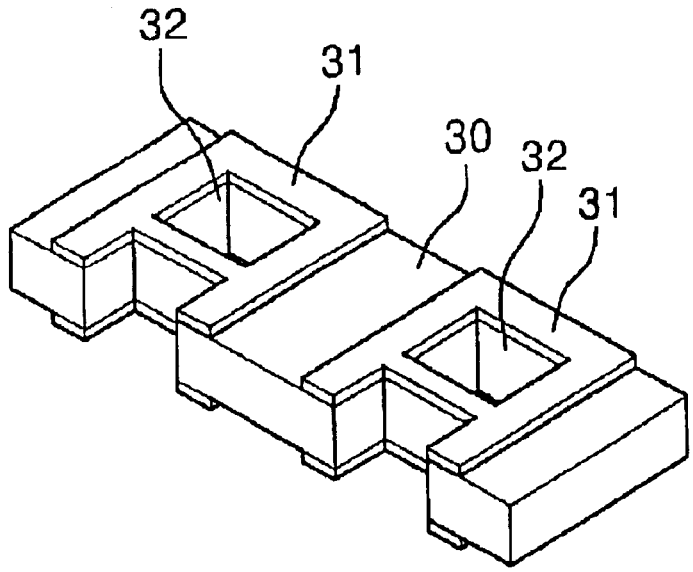
FIG. 7 is a perspective view showing another embodiment of an electrode structure of the color flat-panel display in accordance with the present invention.

FIG. 7 is a view showing another embodiment of an electrode structure of the color flat-panel display in accordance with the present invention.

Referring to FIG. 7, the conductive layer 31 is formed only around the electron beam-passing holes 32 on the insulator 30.

In other words, the conductive layer 31 is formed only around the electron beam-passing holes 32, not on an entire surface of the insulator 30. Therefore, it is possible to manufacture the electrodes at a low cost.

Figure 8:
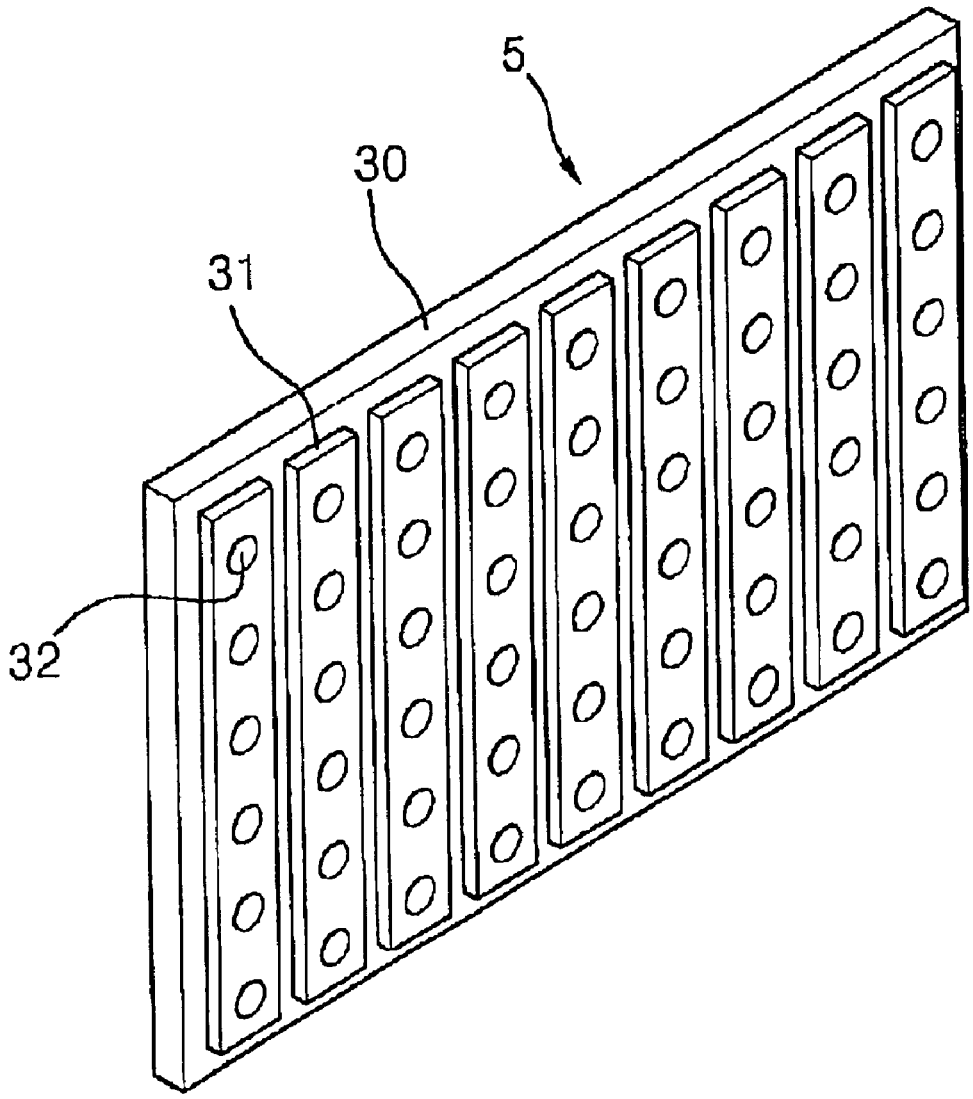
FIG. 8 is a perspective view of the signal modulation electrode in the electrode structure of the color flat-panel display in accordance with the present invention.

Particularly, as shown in FIG. 8, in case of the signal modulation electrode 5, the insulator 30 and the electron beam-passing holes 32 are manufactured in one body and then the conductive layer 31 is formed on a resulting structure, so that the manufacturing process is simplified compared with the prior art.

Figure 9:
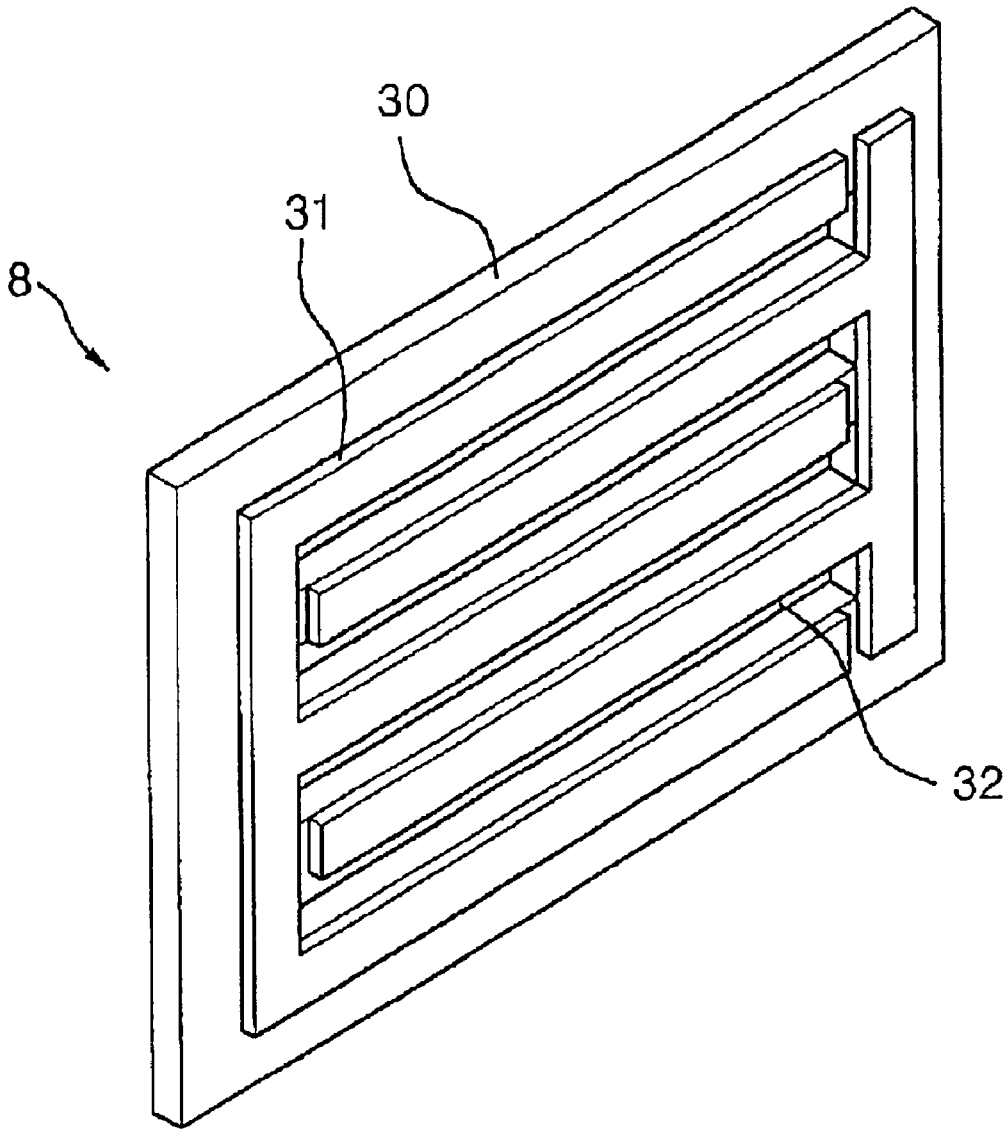
FIG. 9 is a perspective view of the vertical deflection electrode in an electrode structure of the color flat-panel display in accordance with the present invention.

Similarly, as shown in FIG. 9, in case of the vertical deflection electrode 8, the insulator 30 and the electron beam-passing holes 32 of a rectangular shape are manufactured in one body, and then the conductive layer 31 is formed on a resulting structure. At this time, the conductive layer 31 includes two conductive plates meshed with each other on a sectional portion and spaced apart by a predetermined distance on the same plane.

Figure 10:
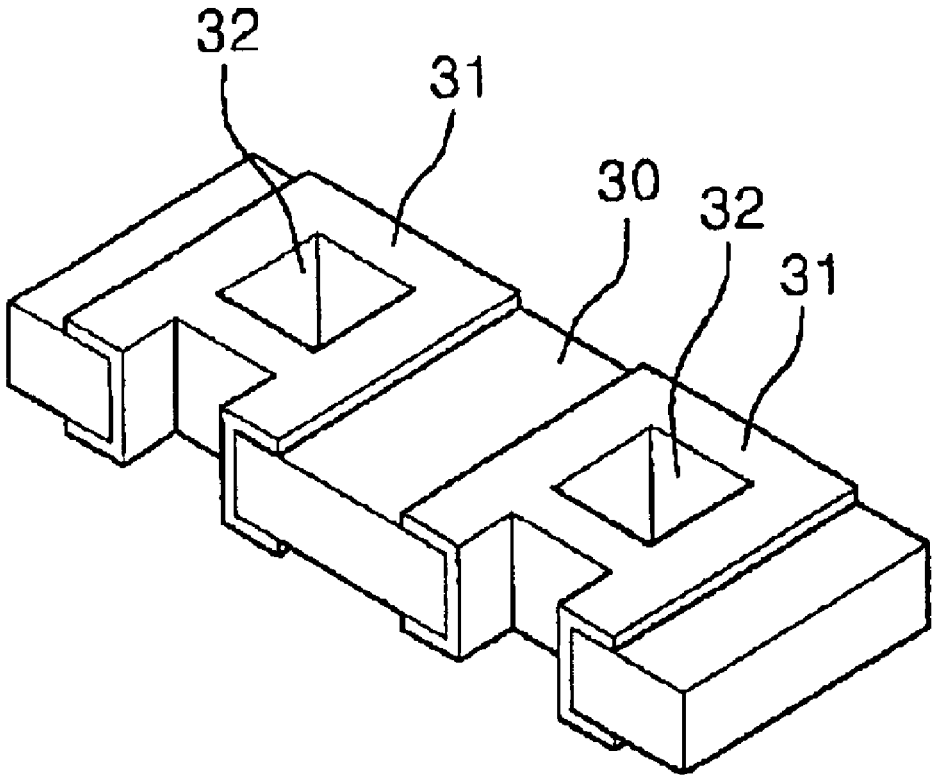
FIG. 10 is a perspective view showing another embodiment of an electrode structure in the color flat-panel display of the present invention.

FIG. 10 is a view showing further another embodiment of an electrode structure of the color flat-panel display in accordance with the present invention.

Referring to FIG. 10, the conductive layers 31 are formed on the insulator 30. At this time, the conductive layers 31 are formed on an inner wall of the electron beam-passing holes 32 as well as both sides of the insulator 30.

In other words, in the electrode structure of the color flat-panel display in accordance with the present invention, the conductive layer 31 can be formed on both sides of the insulator 30. Alternatively, the conductive layer 31 can be formed only around the electron beam-passing holes 32 of the insulator 30. Furthermore, it is also possible to form the conductive layer 31 on the inner wall of the electron beam-passing holes 32, thereby improving an efficiency of the electrodes.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A color flat-panel display comprising:

a rear glass;

a rear electrode;

a filament cathode for emitting electrons;

a control electrode;

a signal modulation electrode;

a focus electrode;

a horizontal deflection electrode;

a vertical deflection electrode;

a front glass on which a phosphor screen is formed;

spacers for maintaining an interval between the electrodes;

wherein each electrode member of the control electrode, the signal modulation electrode, the focus electrode, the horizontal deflection electrode and the vertical deflection electrode includes an insulator;

a conductive layer is formed on a surface of the insulator and acts as an electrode;

the conductive layer has a main component of any one of the materials selected from the group consisting of Au, Al, Pt, Ag, Cu and Ni which are metals having a high conductivity; and the insulator has a main component of at least one of the elements selected from the group consisting of PbO, $B_2O_3$, $SiO_2$, and $Al_2O_3$.

2. A color flat-panel display comprising:

a rear glass;

a rear electrode;

a filament cathode for emitting electrons;

a control electrode;

a signal modulation electrode;

a focus electrode;

a horizontal deflection electrode;

a vertical deflection electrode;

a front glass on which a phosphor screen is formed;

spacers for maintaining an interval between the electrodes;

wherein each electrode member of the control electrode, the signal modulation electrode, the focus electrode, the horizontal deflection electrode and the vertical deflection electrode comprises an insulator having a thickness of 50–150 $\mu$m; and a conductive layer having a thickness of 4–50 $\mu$m is formed on one side of each of the insulators.

3. The color flat-panel display of claim 2, wherein the conductive layer is formed around an electron beam passing hole formed on the insulator.

4. The color flat-panel display of claim 2, wherein the conductive layer is formed on an inner wall of an electron beam passing hole formed on the insulator.

5. A color flat-panel display comprising:

a rear glass;

a rear electrode;

a filament cathode for emitting electrons;

a control electrode;

a signal modulation electrode;

a focus electrode;

a horizontal deflection electrode;

a vertical deflection electrode;

a front glass on which a phosphor screen is formed;

spacers for maintaining an interval between the electrodes;

wherein each electrode member of the control electrode, the signal modulation electrode, the focus electrode, the horizontal deflection electrode and the vertical deflection electrode includes an insulator; and a conductive layer is formed on a surface of the insulator and acts as an electrode.

6. The color flat-panel display of claim 5, wherein the insulator is made with a ceramic-based insulating material.

7. The color flat-panel display of claim 5, wherein main component of the insulator is at least one of the elements selected from the group consisting of PbO, $B_2O_3$, $SiO_2$, and $Al_2O_3$.

8. The color flat-panel display of claim 5, wherein the main component of the conductive layer is any one of the materials selected from the group consisting of Au, Al, Pt, Ag, Cu and Ni which are metals having a high conductivity.

9. The color flat-panel display of claim 5, wherein the insulator is 50–150 $\mu$m thick.

10. The color flat-panel display of claim 5, wherein the conductive layer formed on one side of the insulator is 4–50 $\mu$m thick.

11. The color flat-panel display of claim 5, wherein each electrode is 58–250 $\mu$m thick.

12. The color flat-panel display of claim 5, wherein the overall thickness of the assembly formed by combining the respective electrodes is less than 5000 $\mu$m.

13. The color flat-panel display of claim 5, wherein the control electrode, the signal modulation electrode, the focus electrode, the horizontal deflection electrode and the vertical deflection electrode are manufactured using a printing method.

14. The color flat-panel display of claim 5, wherein the spacers for maintaining the interval between the electrodes are formed with a ceramic material.

15. The color flat-panel display of claim 5, wherein the conductive layer is formed on both sides of the insulator.

16. The color flat-panel display of claim 5, wherein the conductive layer is formed on the entire surface of the insulator.

17. The color flat-panel display of claim 5, wherein the conductive layer is formed on the entire surface of the control electrode and the focus electrode.

18. The color flat-panel display of claim 5, wherein the conductive layer is formed only around an electron beam passing hole formed on the insulator.

19. The color flat-panel display of claim 5, wherein the conductive layer is formed on an inner wall of an electron beam passing hole formed on the insulator.

20. The color flat-panel display of claim 5, wherein the conductive layer formed on the horizontal deflection electrode and the vertical deflection electrode has two conductive plates that mesh with each other and placed on the insulator such that the conductive plates are meshed together at a predetermined distance from each other on the same plane.

* * * * *